US007918496B2

(12) United States Patent
Mackert

(10) Patent No.: US 7,918,496 B2
(45) Date of Patent: Apr. 5, 2011

(54) ARMCHAIR WITH LEG REST THAT IS UNSEEN IN A RETRACTED POSITION

(75) Inventor: Michael Mackert, Ruthen (DE)

(73) Assignee: Kintec-Solution GmbH, Geseke (DE)

( * ) Notice: Subject to any disclaimer, the term of this patent is extended or adjusted under 35 U.S.C. 154(b) by 172 days.

(21) Appl. No.: 12/307,832

(22) PCT Filed: Aug. 14, 2007

(86) PCT No.: PCT/EP2007/058397
§ 371 (c)(1),
(2), (4) Date: Jan. 7, 2009

(87) PCT Pub. No.: WO2008/022939

PCT Pub. Date: Feb. 28, 2008

(65) Prior Publication Data

US 2009/0289477 A1 Nov. 26, 2009

(30) Foreign Application Priority Data

Aug. 19, 2006 (DE) ..... 10 2006 038 736

(51) Int. Cl.
*A47C 1/02* (2006.01)
*A47C 7/50* (2006.01)

(52) U.S. Cl. ..... 297/75; 297/423.28

(58) Field of Classification Search ..... 297/68, 297/75, 76, 423.28, 423.3, 423.35, 423.34, 297/423.36
See application file for complete search history.

(56) References Cited

U.S. PATENT DOCUMENTS

| | | | | |
|---|---|---|---|---|
| 2,919,746 | A * | 1/1960 | Fidel | 297/68 |
| 3,429,612 | A * | 2/1969 | Cobb | 297/75 |
| 5,507,562 | A * | 4/1996 | Wieland | 297/423.2 |
| 6,030,033 | A | 2/2000 | Schultz | |
| 6,742,206 | B1 * | 6/2004 | Han | 5/618 |

FOREIGN PATENT DOCUMENTS

| | | | |
|---|---|---|---|
| DE | 3718645 | A1 | 3/1988 |
| DE | 19830418 | A1 | 2/1999 |
| DE | 202006006678 | U1 | 6/2006 |
| FR | 2864758 | A1 | 7/2005 |
| WO | 2004034849 | A1 | 4/2004 |

OTHER PUBLICATIONS

International Search Report and Written Opinion of the International Searching Authority from corresponding Patent Cooperation Treaty (PCT) Application No. PCT/EP2007/058397, dated May 26, 2008. English Translation of International Preliminary Report on Patentability from corresponding Patent Cooperation Treaty Patent Application No. PCT/EP2007/058397 mailed Aug. 14, 2007.

* cited by examiner

*Primary Examiner* — Milton Nelson, Jr.

(74) *Attorney, Agent, or Firm* — Van Dyke, Gardner, Linn & Burkhart, LLP

(57) ABSTRACT

Armchair with a seat surface and a leg rest which can be pivoted out, wherein the armchair can be pivoted between a sitting position and a reclining position, for which purpose the seat surface can be displaced to the rear in relation to a fixed frame and is articulated in the front region via erecting levers. The leg rest is coupled to the seat surface in such a manner that it is pivoted when the seat surface is displaced to the rear. The leg rest is connected to the erecting levers by a first sliding mounting and is articulated on the fixed frame by a second sliding mounting. The first sliding mounting is connected pivotably to the second sliding mounting, and the second sliding mounting is configured in such a manner that its orientation changes during the pivoting operation. The leg rest has a thigh part and a calf part that are connected pivotably to each other in such a manner that, when the seat surface is displaced to the rear, the calf part is pivoted from a position arranged approximately parallel to the seat surface and below the seat surface into an approximately horizontal position.

14 Claims, 6 Drawing Sheets

ARMCHAIR WITH LEG REST THAT IS UNSEEN IN A RETRACTED POSITION

CROSS REFERENCE TO RELATED APPLICATION

This application claims the priority benefits of International Application No. PCT/EP2007/058397, filed on Aug. 14, 2007, which is hereby incorporated herein by reference in its entirety.

BACKGROUND OF THE INVENTION

The invention concerns an armchair with a seat surface, and, in particular, to such an armchair in which the seat can swivel between a sitting position and a reclining position, for which the seat surface can be displaced to the rear.

Such armchairs are familiar and are also known as sitting and reclining furniture. They allow an adjustment of the position between a "normal" upright sitting position and a reclining position leaning backward and, in some circumstances, far backward, e.g., almost horizontally oriented.

In the reclining position, an additional leg rest can be pivoted forward/upward. The distance between the front edge of the seat surface and the floor, may limit the size of the leg rest. To solve this problem, pull-out leg rests are used, being activated by scissors lever systems, Bowden cable controls, or the like.

For such an armchair, disclosed in DE 296 00 282 U1, it is necessary to press against the armrests to make an adjustment by moving the seat surface, since there is a system of parallel linkages, which moves the body weight or the center of gravity to the rear along with the seat surface when the latter is shifted. The leg rest is connected to the system of parallel linkages such that it extends and retracts during the swiveling. Moreover, the leg rest comes in two parts, in order to create a longer support surface despite small structural size in the retracted condition. The system of parallel linkages requires a relatively large structural height and a toggle mechanism is needed to change the inclination of the seat surface during its movement. A retraction cable is provided to pull in the extended part of the leg rest during the retraction.

DE 198 30 418 A1 discloses an armchair in which the seat element is arranged so that it can be displaced to the rear in relation to the lower frame and it is coupled to the backrest by means of connection, and the backrest is joined to the seat element and the lower frame by adjustment means which can make changes in the angle of tilt of the backrest regardless of the position of the seat surface. Moreover, the foot support is coupled to the lower frame and the seat surface so that it swings forward/upward when the seat surface is moved to the rear. For this, the foot support is coupled to the lower frame and the seat surface by a scissors system arranged on the inside behind or beneath the foot support. As with the armchair known from DE 296 00 282 U1, a Bowden cable control is provided, which is used to shift the plate elements of a double plate arrangement relative to each other.

An armchair is disclosed in DE 20 2005 000 136 U1, whose seat surface consists of a tubular frame, the side tubes being mounted between double roller arrangements provided front and rear, so that the seat surface can shift horizontally.

DE 44 30 303 A1 discloses a seat furniture with fold-out leg support, in which the seat surface swivels upward when the leg support is swung out, to increase the clear height beneath the seat part, so that the leg support can be swiveled out despite having greater length than the clear height. For this, the seat part is articulated with a seat link of the frame near the back piece and the leg support is articulated by one end to a knee link directly on the seat part and they are coupled together so that the seat part can be lifted automatically into intermediate positions during the extension and retraction by swiveling about the seat link on the side of its knee link opposite the floor space.

DE 37 18 645 A1 likewise discloses a sitting furniture with swing-out foot support, in which the foot support can swivel between a folded-out end position basically flush with the seat part and an end position at least partly retracted beneath the seat part. The leg support consists of a thigh part and, articulating with this, a calf or foot part. These are connected by driving and gearing means which are coupled together. In an intermediate position of the fold-out process, the thigh part and the foot part make an acute angle. The driving and gearing means have a coupler mechanism, which comprises a thigh rocker, a foot coupler, and intermediate elements. The thigh rocker is connected to the thigh part and articulated to a seat link fastened to the frame. The foot coupler is connected to the foot part and articulated to a knee link of the thigh rocker. The intermediate elements are connected together at a shared link. One intermediate element is articulated to a guide link of the thigh rocker and the other intermediate element to an extension link of the foot coupler in the vicinity of the knee link. The foot coupler has a lever projecting beyond the extension link at the side opposite the knee link, forming the free end of the foot part. The shared link is in a stable position in both end positions under the action of a holding element.

A mechanism for an armchair is disclosed in WO 2004/034849 A1, which allows for swiveling and, at the same time, pulling out the leg rest by displacing the seat surface to the rear, being situated roughly perpendicularly downward in the retracted condition. For this, the mechanism contains an essentially secured linear extension element, being connected to the frame and pivoted on the leg rest, and a pivoting linear extension element, which is firmly connected to the leg rest and pivoted on the essentially secured linear extension element. The extension elements are configured as telescoping profile rails. One part of the essentially secured profile rail is connected to the frame and the other part pivoted on the leg rest. One part of the pivoting profile rail is pivoted accordingly on the frame and the other part, being firmly connected to the leg rest, is pivoted on the part of the essentially secured profile rail that is pivoted to the leg rest. Also, when the seat surface is displaced, the essentially secured profile rail is changed in its orientation by a parallelogram-like lever system, so that an armchair construction is achieved enabling a smooth and harmonic motion as well as gentle swiveling of the leg rest, despite having a simple and stable construction.

However, in the retracted condition, the leg rest of the design disclosed in WO 2004/034849 A1 is only positioned roughly perpendicular downwards. Thus, a light, elegant overall appearance of the armchair is not fully achieved. Also, the extension and swiveling mechanism may not be easy in operation.

SUMMARY OF THE INVENTION

The invention provides an armchair with a seat surface and a leg rest which can be pivoted out that has an especially simple construction and can adjust between the sitting and reclining position without a complex mechanism. In particular, in the retracted position, the leg rest can be arranged "unseen" beneath the seat surface but nevertheless provide enough support surface for a comfortable accommodation of the legs in the use position. Also, overall movement during the swivel motion may be carried out in a smooth and harmonious manner.

In a preferred embodiment, the leg rest has a thigh part and a calf part, which are pivoted together so that the calf part, when the seat surface is displaced to the rear, is swiveled from a position roughly parallel to the seat surface and arranged underneath the seat surface to a roughly horizontal position. It is possible to swivel in the leg rest beneath the seat surface and roughly parallel to it so that it does not disturb the visual appearance.

In particular, this configuration allows one to provide a leg rest with an especially large support surface, since the leg rest cannot only be pulled out, but also folded open.

The calf part can be articulated by a pivot on the thigh part and be connected by a pivot to the second sliding mounting. In this way, one achieves a simultaneous swiveling out and in and a pulling out and in of the leg rest in simple fashion.

In a preferred embodiment, movement of the leg rest from the swiveled in to the swiveled out position (and vice versa) is achieved in a smooth and harmonious manner when the second sliding mounting is installed between the seat surface and frame so that its angle changes during the swiveling.

The second sliding mounting may be pivoted at one end on the frame, and at the other end, it is articulated by a lever to the seat surface so that it is situated in the rear region and can change its height during the swiveling. The lever may be a multi-part Z-shaped lever, for which the individual component levers can be arranged to swivel relative to each other.

This achieves a firm and stationary arrangement of the second sliding mounting, yet permits a necessary equalizing of the orientation of the second sliding mounting, so that when the leg rest or armchair moves between its positions, nothing gets stuck. It is virtually a floating bearing that is fixed in a narrow region.

The thigh part may be connected by a first sliding mounting to the erecting levers and articulated by the second sliding mounting to the stationary frame, and the thigh part forms the swiveling connection between the first sliding mounting and the second sliding mounting.

These and other objects, advantages and features of this invention will become apparent upon review of the following specification in conjunction with the drawings.

BRIEF DESCRIPTION OF THE DRAWINGS

Further features, details and benefits of the invention will be explained by means of the following description of a sample embodiment by means of the drawings. This shows.

DESCRIPTION OF THE PREFERRED EMBODIMENT

In the figures, the armchair or its basic underlying mechanism is denoted as a whole by 1, while for reasons of clarity a backrest, rotating foot, armrests, and the like, which are well known in the art are not illustrated. The backrest can be appropriately coupled to recline with the movement of the leg rest that is going to be described. Alternatively, the backrest can be configured to be independently adjustable. It should further be understood that the seat surface and leg rest would include an upholstered cushion as is understood in the art, but which will not be illustrated in order to better reveal details of the preferred embodiment.

Figure 1:
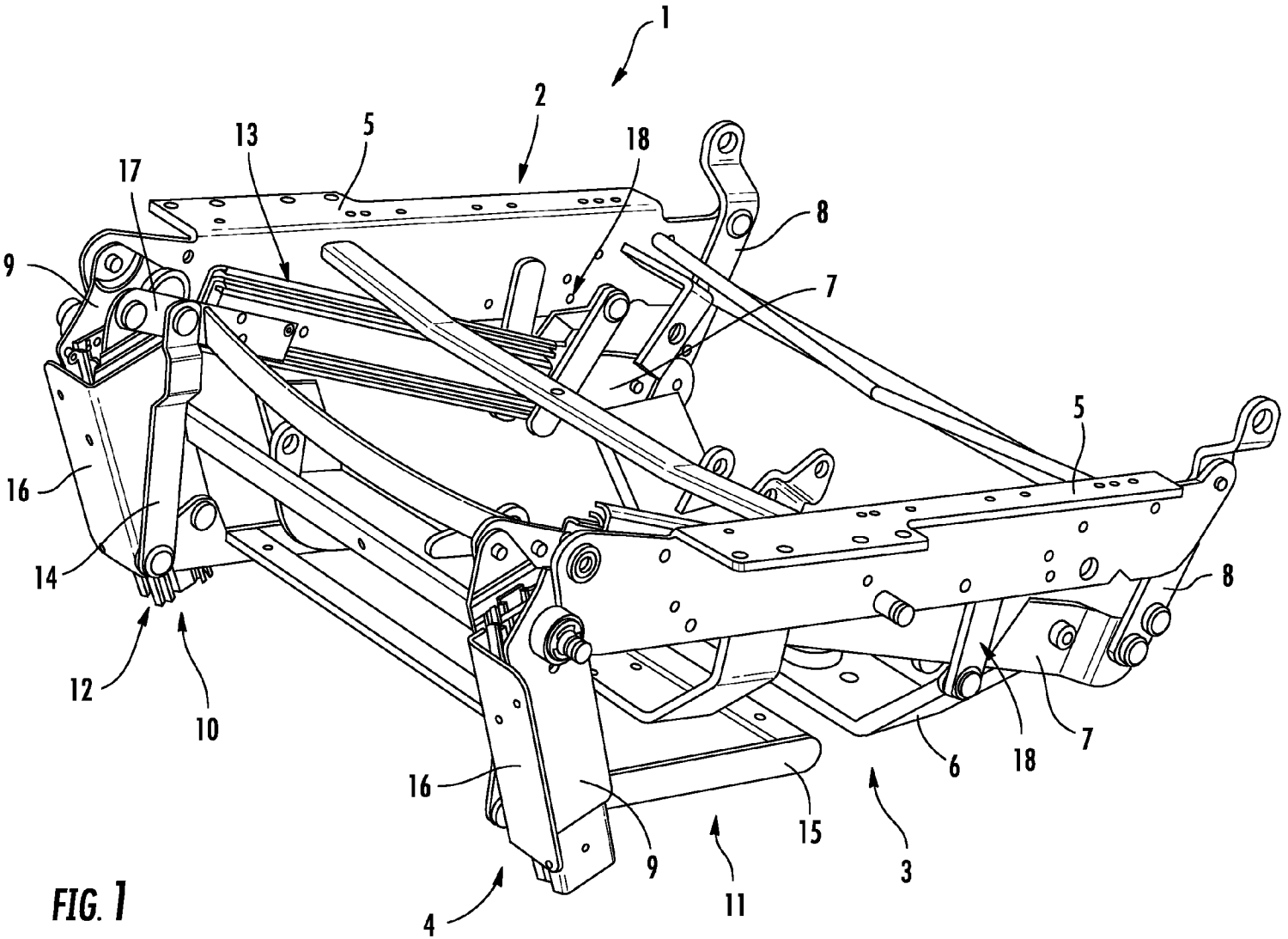
FIG. 1, a perspective view of an armchair according to the invention in a sitting position, the leg rest being in the swiveled in position.
Figure 2:
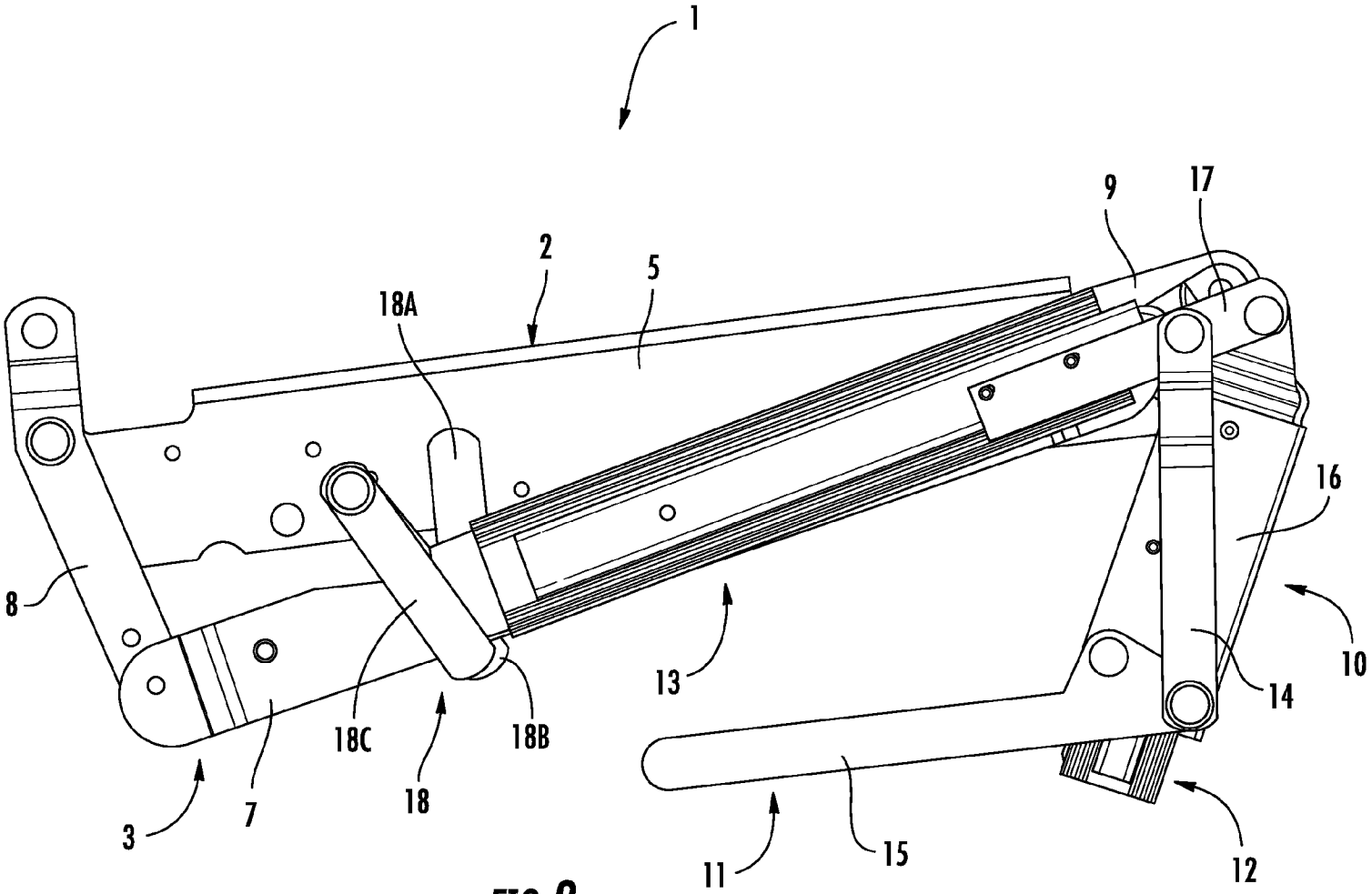
FIG. 2, a side elevation of the armchair of FIG. 1.
Figure 3:
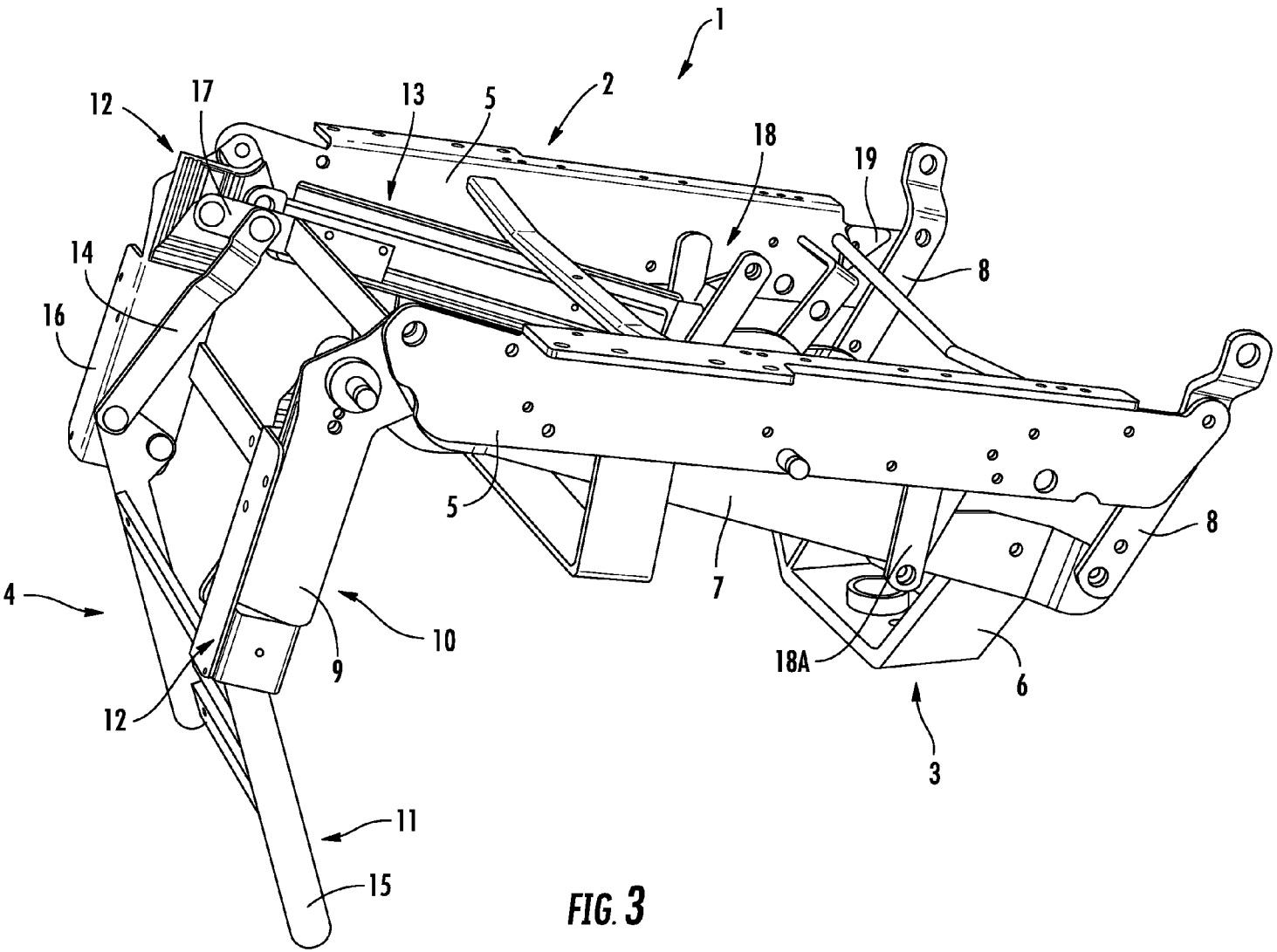
FIG. 3, a perspective view of the armchair of FIG. 1, the leg rest being in an intermediate position while swiveling out.
Figure 4:
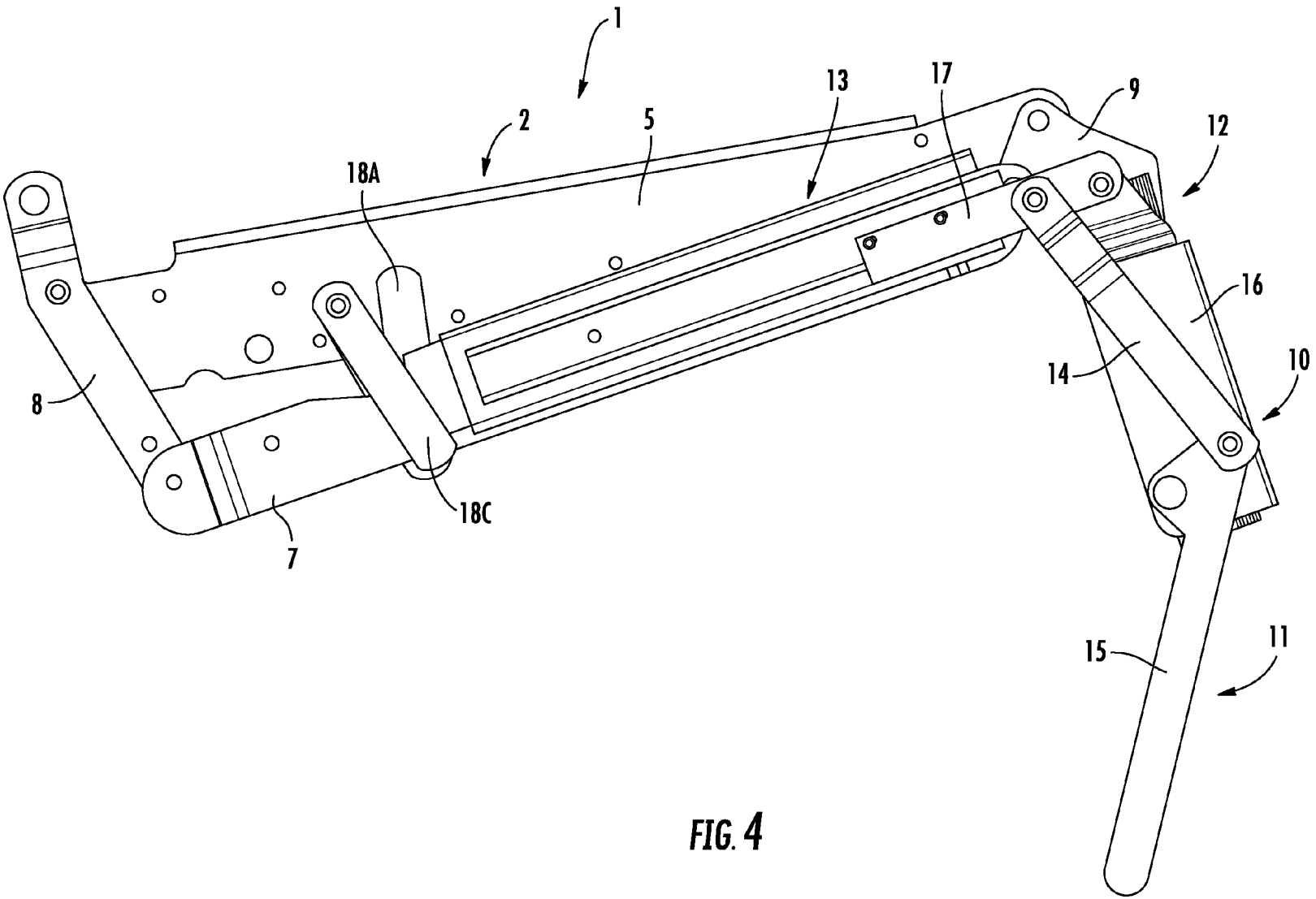
FIG. 4, a side elevation of the armchair of FIG. 3.
Figure 5:
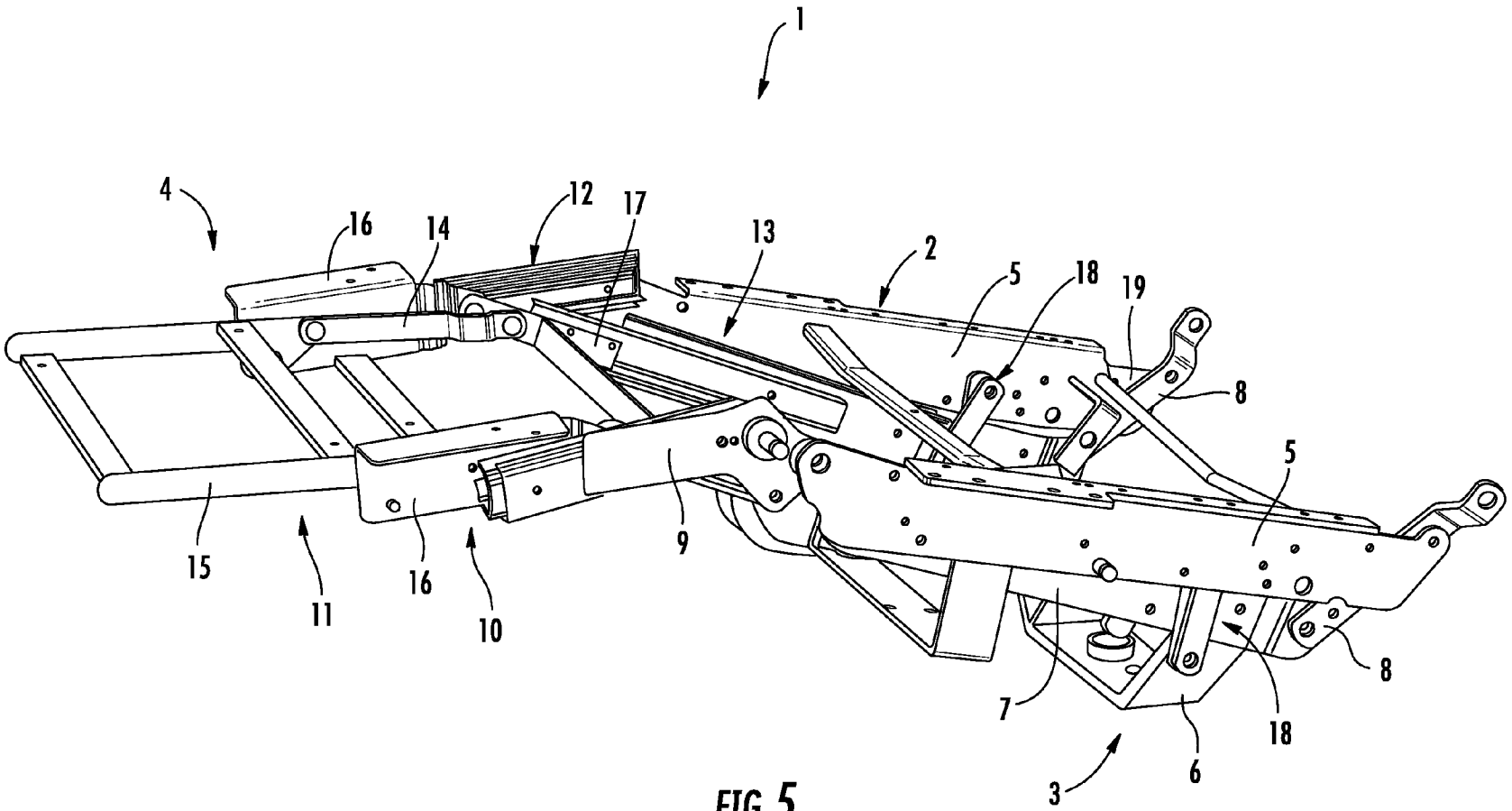
FIG. 5, a perspective view of the armchair of FIG. 1 in a reclining position, where the leg rest is in the swiveled out position, and FIG. 6, a side elevation of the armchair of FIG. 5.
Figure 6:
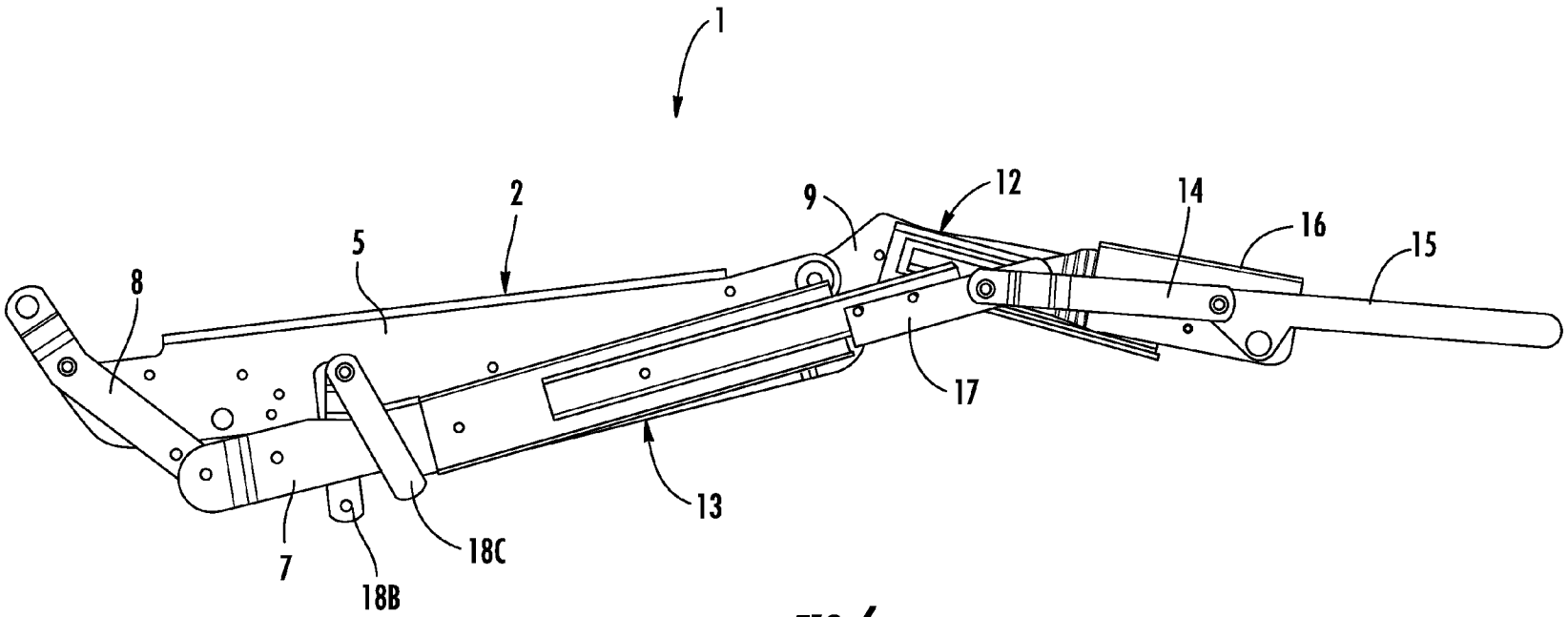

The armchair 1 can be adjusted between a sitting position as shown in FIGS. 1 and 2 and a reclining position as shown in FIGS. 5 and 6, moving through an intermediate position as shown in FIGS. 3 and 4.

The armchair 1 includes a seat surface 2, a fixed frame 3, and a leg rest 4 which can be pulled out and in, as well as be swiveled out and in.

The seat surface 2 is made up of two side walls 5, bent at the top end, being arranged at the respective sides of the armchair and joined by corresponding braces.

The frame 3 is made of a roughly U-shaped support 6, extending downward and fastened to the rotating foot (not shown). Side walls 7, likewise belonging to the frame 3, are arranged at the respective end sides of the support 6, having a shape that slants upward toward the front.

The side walls 5 are joined pivotably in the rear region to the side walls 7 of the frame by a swivel lever 8. In the front region, the side walls 5 are joined accordingly by swiveling erecting levers 9. Thus, to initiate the adjustment movement from the sitting position (see FIG. 1) to the reclining position (see FIG. 5), the seat surface 2 can be displaced to the rear, whereupon the seat surface 2 is slightly lowered in the rear region and slightly lifted in the front region, as compared to the stationary frame 3.

At the front edge of the seat surface 2 or its side walls 5, the leg rest 4 is arranged. This has a thigh part 10 and a calf part 11 pivotably connected to it. The calf part 11, when the seat surface 2 is moved backward, swivels from a position roughly parallel to the seat surface 2 and arranged below the seat surface 2, to a roughly horizontal position.

The calf part 11 consists essentially of levers 15, which are pivoted on the thigh part 10 and joined together by corresponding braces.

The thigh part 10 essentially comprises two angle plates 16 arranged at the respective left and right side of the leg rest 4. The angle plates 16 are joined by first sliding mountings 12 to the erecting levers 9 in linear displaceable manner and by swivel levers 17 to a second sliding mounting 13 in swiveling manner. The swivel levers 17 have transverse bracing.

The leg rest 4 is thus connected by means of the first sliding mounting 12 to the erecting levers 9 and articulated by means of the second sliding mounting 13 via the swivel levers 17 to the stationary frame 3 or the side walls 7. The first sliding mounting 12 is thus pivotably connected to the second sliding mounting 13.

The angle plates 16 of the thigh part 10 are connected by means of the first sliding mounting 12 to the erecting levers 9 and articulated by means of the second sliding mounting 13 to the stationary frame 3 or its side walls 7. The thigh part 10 thus forms the swiveling connection between the first sliding mounting 12 and the second sliding mounting 13.

Furthermore, the calf part 11 is articulated pivotably to the thigh part 10 and connected pivotably by a swiveling lever 14 to the second sliding mounting 13, for which the lever 14 is articulated to the lever 17.

The sliding mountings 12 and 13 are so-called ball rails or slides, and thus consist of profiled rails, arranged to be capable of linear displacement via ball bearings or other anti-friction members.

The first sliding mountings 12 are thus fastened between the erecting levers 9 and the corresponding angle plates 16 of the thigh part 10. Thus, the angle plates 16 are capable of linear displacement relative to the erecting levers 9.

The second sliding mountings 13 are thus articulated in the front region pivotably (not shown) to the respective side wall 7 and configured in the rear region so that their orientation changes during the swivel operation. For this, a corresponding lever 18 is provided, being a multi-part lever, such as a Z-shaped lever. The individual parts 18A, 18B and 18C of lever 18 are arranged to swivel relative to each other.

The one part 18A is welded firmly to the seat surface side wall 5. The second part 18C is pivotably attached to the second sliding mounting 13. Parts 18A and 18C are articulated via the third part 18B.

Thus, when the seat surface 2 is displaced, the lever 17 is compressed or pulled apart, so that the rear region of the second sliding mounting 13 attached to it is raised or lowered.

On the whole, the following motion sequence results when adjusting the armchair 1 from the sitting position (see FIGS. 1 and 2) to the reclining position (see FIGS. 5 and 6):

To start the movement, the user shifts his weight backward, so that the seat surface 2 or its side walls 5 are displaced to the rear as compared to the frame 3 or its side walls 7, the side walls 5 being guided in the rear region by the swivel lever 8.

At the same time, the displacement movement swings the erecting lever 9 forward and upward in the front region, so that the side walls 5 of the seat surface 2 are slightly lifted.

At first, the thigh part 10 is swung upward and forward by the swiveling of the erecting lever 9 (see FIG. 4).

Thanks to the swiveling of the erecting lever 9, the orientation or angle between the sliding mountings 12 and 13 is changed, so that the leg rest 4 begins to swivel out and be pulled out.

At the same time, the change in angle between the sliding mountings 12 and 13 brings about a change in the points of articulation of the lever and a lengthening of the lever or the distances between the points of articulation, so that the calf part 11 begins to fold open and also a pulling out of the first sliding mounting 12 begins.

Parts 18A, 18B and 18C of the Z-shaped lever 18 swivel relative to each other, so that the rear region of the second sliding mounting 13 is slightly lifted by a shortening of the points of articulation of parts 18A, 18B and 18C relative to each other. This ensures a harmonic overall movement that is free of binding.

As the side walls 5 of the seat surface 2 continue to move backward (see FIG. 6), the erecting levers 9 reach their final position, by which the leg rest 4 is fully pulled out and swiveled upward and also folded open. The sliding mountings 12 and 13 are not pulled out.

Parts 18A, 18B and 18C of the Z-shaped lever 18 have run through their vertex point of shortening of the points of articulation of the parts 18A, 18B and 18C relative to each other and once again swing toward or away from each other, so that the rear region of the second sliding mounting 13 after being lifted is now lowered once more.

The final position of the armchair 1 is chosen such and bounded by a limiting element 19 (see FIGS. 3 and 5) as to be adopted or held by the weight of the user. The leg rest 4 is positioned much higher than normal and at the same time offers a longer support surface for the legs.

The adopting of the sitting position can, likewise, be accomplished by shifting of the weight of the user, possibly with support from a spring (not shown), reversing the above described movement sequences.

Changes and modifications in the specifically described embodiments can be carried out without departing from the principles of the present invention, which is intended to be limited only by the scope of the appended claims, as interpreted according to the principles of patent law including the doctrine of equivalents.

LIST OF REFERENCE SYMBOLS

1 armchair
2 seat surface
3 frame
4 leg rest
5 side walls
6 support
7 side walls
8 swivel lever
9 erecting lever
10 thigh part
11 calf part
12 sliding mounting
13 sliding mounting
14 swivel lever
15 lever
16 angle plates
17 swivel lever
18 lever
18A part of lever 18
18B part of lever 18
18C part of lever 18
19 limiting element

The invention claimed is:

1. An armchair that can be adjusted between a sitting position and a reclining position, comprising:

a fixed frame, a seat surface and a leg rest that can be pivoted with respect to said seat surface;

wherein the seat surface can be displaced to the rear in relation to said fixed frame;

erecting levers articulating a front region of said seat surface;

wherein the leg rest is coupled to the seat surface in such a manner that the leg rest is pivoted when the seat surface is displaced to the rear, wherein the leg rest is connected to the erecting levers by means of a first sliding mounting and is articulated on the fixed frame by means of a second sliding mounting, wherein the first sliding mounting is connected pivotably to the second sliding mounting, and wherein the second sliding mounting is configured in such a manner that orientation of the second sliding mounting changes during pivoting of the leg rest;

the leg rest having a thigh part and a calf part, said thigh and calf parts being connected pivotably to each other in such a manner that, when the seat surface is displaced to the rear, the calf part is pivoted from a position arranged approximately parallel to the seat surface and below the seat surface into an approximately horizontal position in line with the seat surface.

2. The armchair as claimed in claim 1 wherein the second sliding mounting is installed between the seat surface and frame so that orientation of the second sliding mounting changes during the pivoting of the leg rest.

3. The armchair as claimed in claim 2 wherein the second sliding mounting is pivoted at one end on the frame and at the other end is articulated by a lever to the seat surface wherein the second sliding mounting is situated in a rear region and can change in height during the pivoting of the leg rest.

4. The armchair as claimed in claim 3 wherein the lever is a multi-part Z-shaped lever.

5. The armchair as claimed in claim 4 wherein said lever is made up of individual lever components that are arranged to swivel relative to each other.

6. The armchair as claimed in claim 5 wherein the thigh part is connected by the first sliding mounting to the erecting levers and is articulated by the second sliding mounting to the frame, and the thigh part forms a swiveling connection between the first sliding mounting and the second sliding mounting.

7. The armchair as claimed in claim 6 wherein the calf part is articulated with respect to the thigh part by a first pivot and is connected by a second pivot to the second sliding mounting.

8. The armchair as claimed in claim 1 wherein the second sliding mounting is pivoted at one end on the frame and at the other end is articulated by a lever to the seat surface wherein the second sliding mounting is situated in a rear region and can change in height during the pivoting of the leg rest.

9. The armchair as claimed in claim 8 wherein the lever is a multi-part Z-shaped lever.

10. The armchair as claimed in claim 9 wherein said lever is made up of individual lever components that are arranged to swivel relative to each other.

11. The armchair as claimed in claim 10 wherein the thigh part is connected by the first sliding mounting to the erecting levers and is articulated by the second sliding mounting to the frame, and the thigh part forms a swiveling connection between the first sliding mounting and the second sliding mounting.

12. The armchair as claimed in claim 1 wherein the thigh part is connected by the first sliding mounting to the erecting levers and is articulated by the second sliding mounting to the stationary frame, and the thigh part forms a swiveling connection between the first sliding mounting and the second sliding mounting.

13. The armchair as claimed in claim 12 wherein the calf part is articulated with respect to the thigh part by a first pivot and is connected by a second pivot to the second sliding mounting.

14. The armchair as claimed in claim 1 wherein the calf part is articulated with respect to the thigh part by a first pivot and is connected by a second pivot to the second sliding mounting.

* * * * *